US007314333B2

(12) United States Patent
Shaw et al.

(10) Patent No.: US 7,314,333 B2
(45) Date of Patent: Jan. 1, 2008

(54) PLATE CONCRETE DOWEL SYSTEM

(75) Inventors: Lee A. Shaw, Newport Beach, CA (US); Ronald D. Shaw, Corona Del Mar, CA (US)

(73) Assignee: Shaw & Sons, Inc., Costa Mesa, CA (US)

( * ) Notice: Subject to any disclaimer, the term of this patent is extended or adjusted under 35 U.S.C. 154(b) by 19 days.

(21) Appl. No.: 11/400,006

(22) Filed: Apr. 7, 2006

(65) Prior Publication Data

US 2006/0182496 A1 Aug. 17, 2006

Related U.S. Application Data

(63) Continuation-in-part of application No. 11/103,863, filed on Apr. 12, 2005, now abandoned, which is a continuation of application No. 10/640,556, filed on Aug. 13, 2003, now Pat. No. 6,926,463.

(51) Int. Cl.
*E01C 11/14* (2006.01)

(52) U.S. Cl. ..... 404/60; 404/58; 404/65; 404/66

(58) Field of Classification Search ..... 404/51–61
See application file for complete search history.

(56) References Cited

U.S. PATENT DOCUMENTS

| | | | |
|---|---|---|---|
| 754,215 | A | 3/1904 | Hayward |
| 2,096,702 | A | 10/1937 | Yeoman |
| 2,166,220 | A | 7/1939 | Older |
| 2,181,005 | A | 11/1939 | Westcott |
| 4,077,177 | A | 3/1978 | Boothroyd et al. |
| 4,087,072 | A | 5/1978 | Olsen |
| 4,252,767 | A | 2/1981 | Piazza et al. |
| 4,493,584 | A | 1/1985 | Guntert |

(Continued)

FOREIGN PATENT DOCUMENTS

| | | |
|---|---|---|
| EP | 1 123 443 | 1/2004 |

(Continued)

OTHER PUBLICATIONS

WWW.PNA-INC.COM; "The Diamond Dowel System"; May 22, 2003; 2 pages.

(Continued)

*Primary Examiner*—Raymond W Addie
(74) *Attorney, Agent, or Firm*—Stetina Brunda Garred & Brucker

(57) ABSTRACT

A disc dowel system is interposed between adjacent first and second concrete pours defining a pour joint therebetween. The disc dowel system comprises a positioner bracket, a pocket former and an orthogonally shaped dowel plate. The positioner bracket has a horizontal plate portion and a vertical base flange that is rigidly attachable to a concrete form. The pocket former has a horizontally extending interior compartment with an open straight side that is aligned with the pour joint. The pocket former is positioned within the first pour by the positioner bracket. The dowel plate has an orthogonal shape with an embedded portion and a slidable portion. The embedded portion is rigidly encapsulated within the second pour. The slidable portion is slidably disposed within the pocket former such that the dowel plate permits relative horizontal movement of the first and second pours while restricting relative vertical movement thereof.

22 Claims, 3 Drawing Sheets

U.S. PATENT DOCUMENTS

| | | | |
|---|---|---|---|
| 4,801,425 | A | 1/1989 | Michel et al. |
| 5,005,331 | A | 4/1991 | Shaw et al. |
| 5,046,898 | A | 9/1991 | McKinney |
| 5,096,155 | A | 3/1992 | Fitzgerald |
| 5,205,942 | A | 4/1993 | Fitzgerald |
| 5,216,862 | A | 6/1993 | Shaw et al. |
| 5,487,249 | A | 1/1996 | Shaw et al. |
| 5,678,952 | A | 10/1997 | Shaw et al. |
| 5,694,730 | A | 12/1997 | Del Rincon et al. |
| 5,934,821 | A | 8/1999 | Shaw et al. |
| D419,700 | S | 1/2000 | Shaw et al. |
| 6,018,833 | A | 2/2000 | Imm |
| 6,123,485 | A | 9/2000 | Mirmiran et al. |
| 6,145,262 | A | 11/2000 | Schrader et al. |
| 6,210,070 | B1 | 4/2001 | Shaw et al. |
| 6,243,994 | B1 | 6/2001 | Bernini |
| 6,354,053 | B1 | 3/2002 | Kerrels |
| 6,354,760 | B1 | 3/2002 | Boxall et al. |
| D459,205 | S | 6/2002 | Shaw et al. |
| 6,517,277 | B2 | 2/2003 | Hu et al. |
| 6,655,869 | B1 | 12/2003 | Deeb et al. |
| 6,926,463 | B2 | 8/2005 | Shaw et al. |

FOREIGN PATENT DOCUMENTS

| | | |
|---|---|---|
| EP | 1 389 648 | 2/2004 |
| WO | PCT/F199/00865 | 4/2000 |

OTHER PUBLICATIONS

WWW.PAVEMENT.COM; "Load Transfer"; May 27, 2003; 2 pages.

WWW.DANLEY.COM; "Danley Diamond Dowel System"; 2 pages.

Wayne W. Walker/Jerry A. Holland; "Plate Dowels for Slabs on Ground"; 4 pages.

PLATE CONCRETE DOWEL SYSTEM

CROSS-REFERENCE TO RELATED APPLICATIONS

This application is a continuation-in-part application of U.S. application Ser. No. 11/103,863 now abandoned, entitled DISK PLATE CONCRETE DOWEL SYSTEM, filed on Apr. 12, 2005, which is a continuation of U.S. application Ser. No. 10/640,556, filed Aug. 13, 2003, now U.S. Pat. No. 6,926,463, the entire contents of each being expressly incorporated by reference herein. This application is also related to co-pending U.S. application Ser. No.11/360,828, entitled PLATE CONCRETE DOWEL SYSTEM, filed on Feb. 23, 2006, the entire contents of which is expressly incorporated by reference herein.

STATEMENT RE: FEDERALLY SPONSORED RESEARCH/DEVELOPMENT (Not Applicable)

BACKGROUND

The present invention relates generally to concrete forming equipment and, more particularly, to a uniquely configured disc dowel system that is specifically adapted to prevent relative vertical movement of adjacently disposed concrete slabs.

During construction of concrete pavement such as for sidewalks, driveways, roads and flooring in buildings, cracks may occur due to uncontrolled shrinkage or contraction of the concrete. Such cracks are the result of a slight decrease in the overall volume of the concrete as water is lost from the concrete mixture during curing. Typical contraction rates for concrete are about one-sixteenth of an inch for every ten feet of length. Thus, large cracks may develop in concrete where the overall length of the pavement is fairly large. In addition, the cracks may continue to develop months after the concrete is poured due to induced stresses in the concrete.

One of the most effective ways of controlling the location and direction of the cracks is to include longitudinal control joints or contraction joints in the concrete. Contraction joints are typically comprised of forms having substantially vertical panels that are positioned above the ground or subgrade and held in place utilizing stakes that are driven into the subgrade at spaced intervals. The forms act to subdivide or partition the concrete into multiple sections or slabs that allow the concrete to crack in straight lines along the contraction joint. By including contraction joints, the slabs may move freely away from the contraction joint during concrete shrinkage and thus prevent random cracking elsewhere.

In one system of concrete construction, forms are installed above the subgrade to create a checkerboard pattern of slabs. A first batch of wet concrete mixture is poured into alternating slabs of the checkerboard pattern. After curing, forms may be removed and the remaining slabs in the checkerboard pattern are poured from a second batch of concrete. Although effective in providing longitudinal contraction joints to prevent random cracking, the checkerboard system of concrete pavement construction is both labor intensive and time consuming due to the need to remove the forms and due to the waiting period between the curing of the first batch and the pouring of the second batch of concrete.

In another system of concrete construction known as monolithic pour technique, the pour joints are installed above the subgrade in the checkerboard pattern. However, all of the slabs of the checkerboard pattern are poured in a single pour thereby reducing pour time as well as increasing labor productivity. An upper edge of the forms then serves as a screed rail for striking off or screeding the surface of the concrete so that the desired finish or texture may be applied to the surface before the concrete cures. The pour joints, comprised of vertically disposed forms, remain embedded in the concrete and provide a parting plane from which the slabs may move freely away during curing. The pour joints additionally allow for horizontal displacement of the slabs caused by thermal expansion and contraction of the slabs during normal everyday use.

Unfortunately, vertical displacement of adjacent slabs may also occur at a joint due to settling or swelling of the substrate below the slab or as a result of vertical loads created by vehicular traffic passing over the slabs. The vehicular traffic as well as the settling or swelling of the subgrade may create a height differential between adjacent slabs. Such height differential may result in an unwanted step or fault in a concrete sidewalk or roadway or in flooring of a building creating a pedestrian or vehicular hazard. Furthermore, such a step may allow for the imposition of increased stresses on the corner of the concrete slab at the joint resulting in degradation and spalling of the slab. In order to limit relative vertical displacement of adjacent slabs such that steps are prevented from forming at the joints, a form of vertical load transfer between the slabs is necessary.

One system for limiting relative vertical displacement and for transferring loads between slabs is provided by key joints. In key joint systems, the form is configured to impart a tongue and groove shape to respective ones of adjacent slabs. Typically preformed of steel, such a key joint imparts the tongue and groove shape to adjacent slabs in order to allow for contraction and expansion of the adjacent slabs while limiting the relative vertical displacement thereof due to vertical load transfer between the tongue and groove. The tongue of one slab is configured to mechanically interact with the mating groove of an adjacent slab in order to provide reactive shear forces across the joint when a vertical load is place on one of the slabs. In this manner, the top surfaces of the adjacent slabs are maintained at the same level despite swelling or settling of the subgrade underneath either one of the slabs. Additionally, edge stresses of each of the slabs are minimized such that chipping and spalling of the slab corners may be reduced.

Although the key joint presents several advantages regarding its effectiveness in transferring loads between adjacent slabs, key joints also possess certain deficiencies that detract from their overall utility. Perhaps the most significant of these deficiencies is that the tongue of the key joint may shear off under certain loading conditions. Furthermore, the face of the key joint may spall or crack above or below the groove under load. The location of the shearing or spalling is dependent on whether the load is applied on the tongue side of the joint or the groove side of the joint. If the vertical load is applied on the tongue side, the failure will occur at the bottom portion of the groove. Conversely, if the vertical load is applied on the groove side of the joint, the failure will occur near the upper surface of the slab upon which the load is applied.

Shear failure of the tongue and groove may also occur due to opening of the key joint as a result of shrinkage of the concrete slab. As the key joint opens up over time, the groove side may become unsupported as the tongue moves away. Vertical loading of this unsupported concrete causes cracking and spalling parallel to the joint. Such cracking and spalling may occur rapidly if hard-wheeled traffic such as forklifts are moving across the joint. Another deficiency associated with key joint systems is related to the size, configuration and vertical placement of the tongue and groove within the key joint. If excessively large key joints are formed in adjacent slabs or if the tongue and groove are biased toward an upper surface of the slabs instead of being placed at a more preferable midheight location, spalls may occur at the key joint. Such spalls occurring from this type of deficiency typically run the entire length of the longitudinal key joint and are difficult to repair.

Other systems for limiting relative vertical displacement and for transferring loads between adjacent slabs involve methods of placing slip dowels within edge portions of the slabs across a pour joint as disclosed in U.S. Pat. Nos. 5,487,249, 5,678,952, 5,934,821, 6,210,070, 5,005,331, D419,700 and D459,205, each of which is issued to Shaw et al. Each one of these patents discloses various alternatives for installing slip dowels across the pour joint. The slip dowels are typically configured as smooth steel dowel rods that are placed within the edge portions in a manner such that the concrete slabs may slide freely along the slip dowels thereby permitting expansion and contraction of the slabs while simultaneously maintaining the slabs in a common plane and thus prevent unevenness or steps from forming at the joint. However, in order to function effectively, the slip dowels must be accurately positioned parallel within the adjoining concrete slabs. The positioning of the slip dowels in a non-parallel fashion prevents the desired slippage and thus defeats the purpose of the slip dowel system.

In addition, the individual dowel rods must be placed within one or both of the slabs in such a manner so as to permit unhindered slippage or movement of the dowel rod within the cured concrete slab(s). Unfortunately, because such slip dowels must be perfectly aligned in order to allow the adjacent concrete slabs to slide freely away from the joint, installation of slip dowels is labor intensive. In addition, slip dowels allow movement of the concrete slabs in one direction only (i.e., normal to the joint) while not permitting any lateral movement of the slabs (i.e., parallel to the joint) which may result in cracking of the slabs outside of the joint. Furthermore, because the dowel rods are extended outwardly from each side of the joint prior to pouring of the concrete and because of their relatively small diameter, the dowel rods present a safety hazard to personnel who may be injured by contact with rough, exposed ends of the dowel rods. Finally, such dowel rods may be accidentally bent as a result of contact with equipment and site traffic during construction resulting in misalignment of the dowel rods and locking of the joint.

In an effort to alleviate the labor intensive installation and inherently hazardous nature of the above-described slip dowel system as well as allow the slabs to move both normally and laterally relative to the joint, a diamond plate dowel system has been developed for limiting relative vertical displacement and for transferring loads between slabs. The diamond plate dowel system is typically comprised of a pocket former that is attached to a side of a concrete form such as a wooden form. The pocket former is configured such that opposing corners of the diamond plate are aligned with the joint. After pouring the slab on one side of the joint which encases the pocket therein, a diamond shaped plate is inserted into the pocket former immediately prior to pouring the abutting slab on the opposite side of the joint. The diamond plate allows the slabs to move unrestrained both normally and laterally relative to the form as the gap between the slabs opens up. In addition, the diamond pate has increased surface area as compared to dowel placement systems. The surface are of the diamond plate is also oriented as it is widest where the maximum shear and bearing loads are the greatest (i.e., along the joint) and narrowest where the loads on the diamond plate are at a minimum (i.e., away from the joint).

Unfortunately, the diamond plate dowel system suffers from several inherent drawbacks. One of these drawbacks is related to the orientation of the diamond plate which, as was earlier mentioned, is at its widest point along the joint and which tapers to a point at a distance away from the joint. Although such orientation may provide certain load-bearing benefits regarding relative vertical displacement of the adjacent slabs, the same orientation also creates certain drawbacks during lateral displacement of the slabs. Ideally, when the slabs are disposed in abutting relationship with one another at the joint, the perimeter edge of the diamond plate is also disposed in abutting or nearly-abutting contact with the interior compartment of the pocket former within which the diamond plate is slidably disposed. However, when the adjacent slabs move laterally away from one another (i.e., in opposite directions away from the joint to create a gap between the slabs), a spacing develops the perimeter of the diamond plate and the interior compartment increases.

As the slabs move further away from one another (i.e., the amount of laterally opposing displacement increases), the spacing proportionately increases between the perimeter of the diamond plate and the interior of the pocket former. Unfortunately, the increase in such spacing allows the slabs to move sideways relative to one another (i.e., along the joint) which, in turn, may result in the creation of gaps at joints between other slabs. In a concrete walkway or roadway system that is comprised of a checkerboard system of many slabs each having criss-crossing joints, the development of gaps at the numerous cross-crossing joints may create pedestrian or vehicular hazards. In addition, the aesthetics of the concrete walkway or roadway system deteriorates over time with the unsightly creation of gaps at the joints.

As can be seen, there exists a need in the art for a dowel system capable of minimizing laterally sideways displacement (i.e., along the joint) of adjacent concrete slabs while allowing for laterally opposing displacement (away from the joint) of the slabs. Furthermore, there exists a need for a dowel system that may be readily installed within adjacent concrete slabs and which is configured to maintain the slabs in a common plane while allowing for laterally opposing movement of the slabs. Finally, there exists a need for a dowel system of simple and low cost construction and which may be easily installed with a minimum of labor and which does not present a safety hazard during installation.

BRIEF SUMMARY

The present invention specifically addresses and alleviates the above-referenced deficiencies associated with dowel systems of the prior art. More particularly, the present invention is a disc dowel system that is specifically adapted to minimize relative vertical displacement of adjacently disposed concrete slabs while allowing relative horizontal movement thereof. The disc dowel system comprises a dowel plate and corresponding pocket former installed at a pour joint between a first concrete pour and a second concrete pour disposed above a subgrade or a substrate. The disc dowel system may further include a positioner bracket for positioning the pocket former within the first pour.

The dowel plate has a generally orthogonal (i.e., square, rectangular) shape that is divided into an embedded portion and a slidable portion. The slidable portion is configured to be laterally slidable within the pocket former while the embedded portion is configured to be substantially encapsulated or embedded within the second pour such that it is rigidly affixed therewithin after the concrete cures or hardens. Advantageously, the dowel plate is provided in the generally orthogonal shape in order to minimize laterally sideways movement (i.e., parallel to the joint) of an adjacent pair of slabs during laterally opposing motion of the slabs (i.e., perpendicular to the joint).

The pocket former has a horizontally-extending interior compartment which may be bounded by a pair of spaced apart, upper and lower former plates defining generally planar, upper and lower inner surfaces. The interior compartment may have an open, generally straight side defining a compartment opening and an opposing pair of compartment sides and a compartment end collectively defining the interior compartment. Crush ribs may be provided on each one of the compartment sides and which are configured to deflect or crush when the dowel plate bears thereagainst. The interior compartment is preferably configured to be complementary to the dowel plate and, in this regard, may have an orthogonally shaped compartment perimeter. The interior compartment is also preferably configured with the spacing between the upper and lower former plates being complementary to a thickness of the dowel plate such that a sliding fit is provided therebetween. In this manner, the pocket former creates a void in the first pour such that the dowel plate may be slidably received within the form. In one embodiment, the interior compartment and a perimeter edge of the dowel plate are in nearly-abutting contact (or abutting) contact with one another.

The embedded portion of the dowel plate is rigidly encapsulated within the second pour and the slidable portion of the dowel plate is slidably disposed within the pocket former such that the dowel plate permits substantially unrestrained relative horizontal movement of the first and second pours in the horizontal direction while restricting relative vertical movement thereof caused by vertical loading. Horizontal movement relative to the pour joint may occur due to uncontrolled shrinkage or contraction of the concrete mixture as water is lost during curing. As was mentioned above, the crush ribs are configured to deflect to allow relative side-to-side horizontal motion of the first and second pours. Vertical loading may be comprised of shear, bearing and flexural loads or any combination thereof caused by settling or swelling of the substrate underlying the first and/or second pours. The vertical loading may also be caused by vehicular or pedestrian traffic passing over the first and second pours.

The disc dowel system may include a positioner bracket that is mounted to a removable concrete form. The positioner bracket facilitates positioning the pocket former during pouring of the first pour. In certain methods of concrete pavement construction, pour joints are typically formed by using a wooden stud or a sheet metal form as the removable concrete form. Such concrete form is typically staked to the substrate along a desired location of the pour joint. The pocket former is positioned adjacent the concrete form such that the interior compartment is substantially horizontally outwardly extending away from the concrete form.

Wet concrete is then poured on a side of the concrete form to create the first pour which encapsulates the pocket former. The concrete form is then removed, exposing a pour face of the pour joint along the first pour with the dowel plate opening formed in the pour face. After the slidable portion of the dowel plate is inserted through the dowel plate opening and into the pocket former, the embedded portion remains exposed on an opposite side of the pour joint. Wet concrete is then poured on the opposite side of the pour joint to create the second pour which rigidly encapsulates the embedded portion of the dowel plate therewithin.

The positioner bracket includes a vertically-disposed base flange and a horizontally disposed plate portion that extends from the base flange. The base flange is rigidly attachable to the concrete form by any variety of means such as with fasteners. The plate portion of the positioner bracket is configured to be complementary to the interior compartment such that the positioner bracket may slidably receive the pocket former with a relatively snug fit. In this manner, the pocket former is held in a generally horizontal orientation during pouring of the first pour and prior to removal of the concrete form and positioner bracket after which the slidable portion of the dowel plate may be inserted into the interior compartment with the subsequent pouring of the second pour to encapsulate the embedded portion therewithin.

BRIEF DESCRIPTION OF THE DRAWINGS

These as well as other features of the present invention will become more apparent upon reference to the drawings wherein.

DETAILED DESCRIPTION

Figure 1:
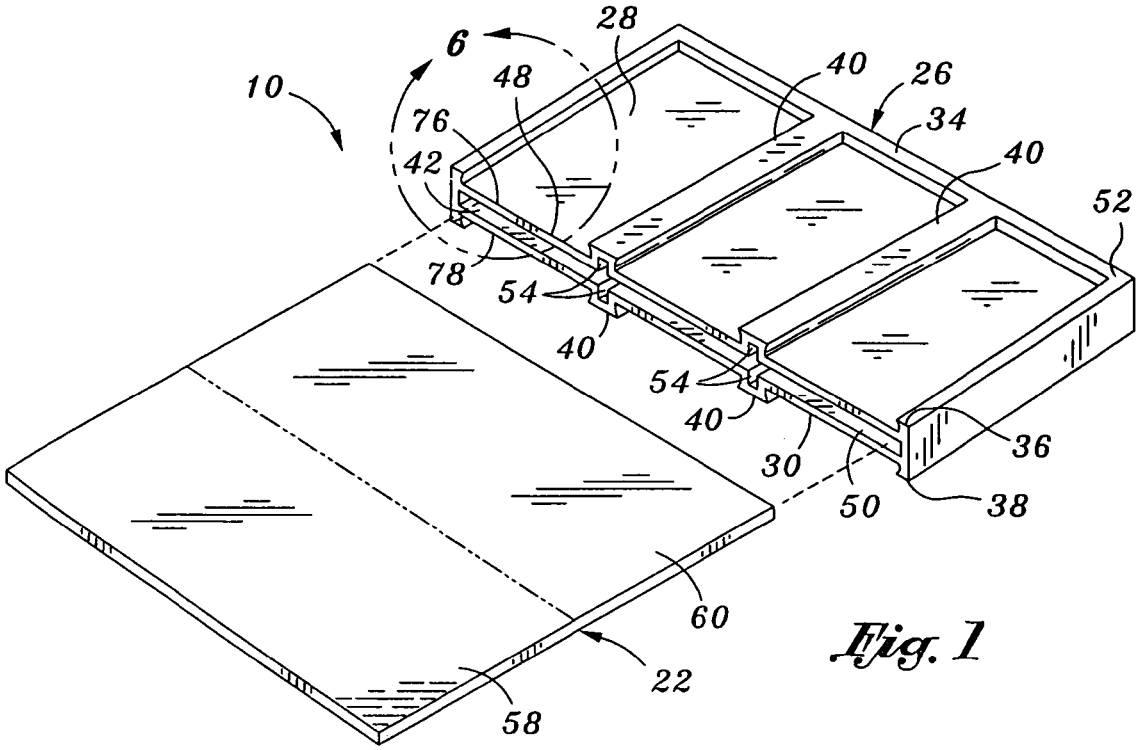
FIG. 1 is an exploded perspective view of a disc dowel system of the present invention illustrating a dowel plate and corresponding pocket former.
Figure 5:
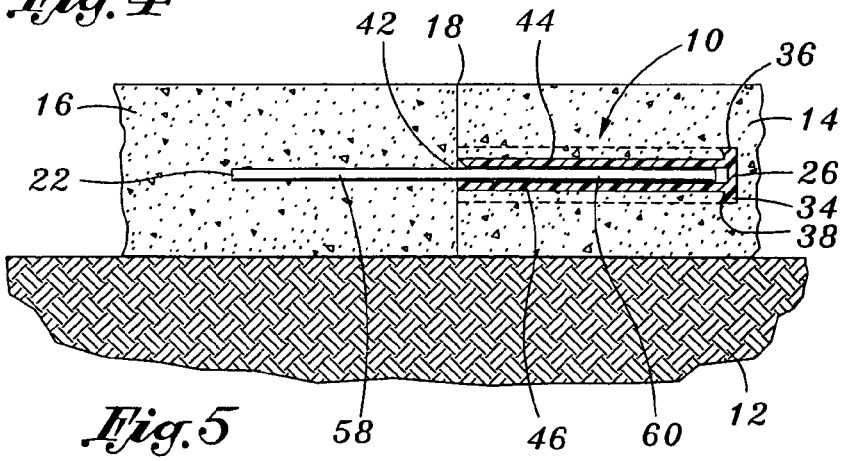
FIG. 5 is a cross-sectional view illustrating the manner in which the pocket former and associated dowel plate shown in FIGS. 1 and 2 are positioned after the concrete form and positioner bracket are removed and the second pour is poured.

Referring now to the drawings wherein the showings are for purposes of illustrating the present invention and not for purposes of limiting the same, FIG. 1 illustrates a dowel plate 22 and corresponding pocket former 26 of the disc dowel system 10 of the present invention. The disc dowel system 10 is installed at a pour joint 18 between a first concrete pour 14 and a second concrete pour 16 disposed above a subgrade or a substrate 12, as can be seen in FIG. 5. The substrate 12 may be soil underlying the first and second pours 14, 16. Alternatively, the substrate 12 may be a metal decking or other surface that is adapted to support concrete.

Figure 2:
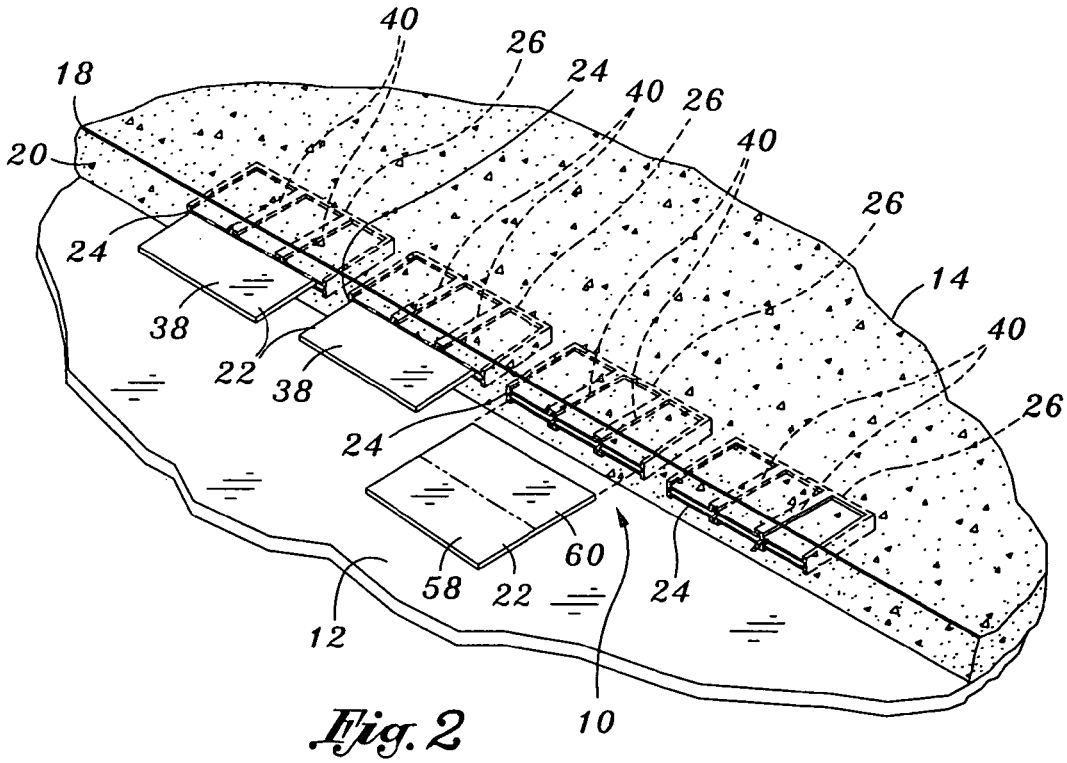
FIG. 2 is a perspective view illustrating the manner in which a series of pocket formers of the disc dowel systems are used to properly align respective ones of the dowel plates at a pour joint between adjacent first and second concrete pours.
Figure 3:
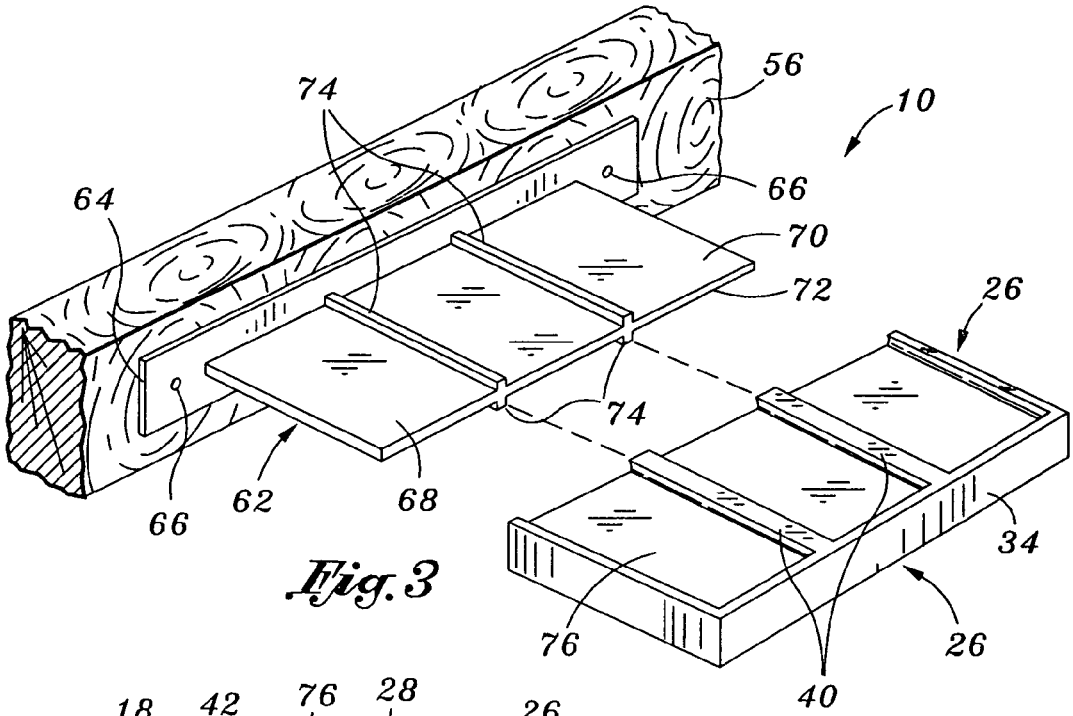
FIG. 3 is an exploded perspective view of the disc dowel system illustrating a positioner bracket mounted on a concrete form with which the disc dowel system is preferably utilized in order to position the pocket former within the first pour.
Figure 4:
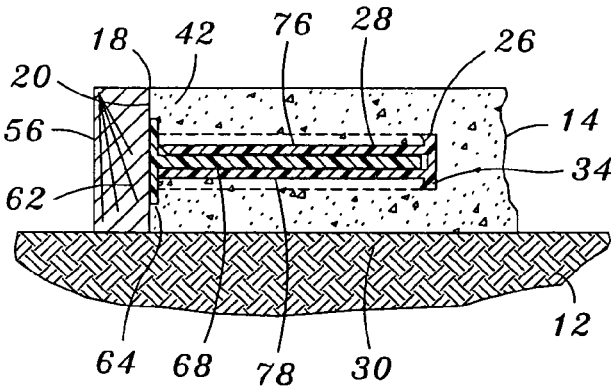
FIG. 4 is a cross-sectional view illustrating the manner in which the positioner bracket and associated pocket former shown in FIG. 3 are positioned after the first pour is poured.

As can be seen in FIGS. 1 and 2, the disc dowel system 10 is comprised of the dowel plate 22 and the pocket former 26. In FIG. 2, a series of the pocket formers 26 are shown encapsulated in the first pour 14 prior to pouring of the second pour 16. The disc dowel system 10 may further include a positioner bracket 62 for positioning the pocket former 26 within the first pour 14 as is illustrated in FIGS. 3 through 5 and as will be described in greater detail below. As can be seen in FIGS. 1 and 2, the dowel plate 22 has a generally orthogonal shape that is divided into an embedded portion 58 and a slidable portion 60. The embedded portion 58 and the slidable portion 60 may be of substantially equal size and shape. As will be explained in greater detail below, the slidable portion 60 is configured to be laterally slidable within the pocket former 26 while the embedded portion 58 is configured to be substantially encapsulated within the second pour 16 such that it is rigidly affixed therewithin after the concrete cures or hardens.

As can be seen in FIG. 1, the dowel plate 22 may advantageously be provided in a generally orthogonal shape such as in a square or rectangular shape. However, it is contemplated that there are a number of alternative shapes of the dowel plate 22 that may be used in the disc dowel system 10. In this manner, the dowel plate 22 may preferably be shaped such that laterally sideways displacement of the slabs is prevented regardless of the amount of laterally opposing displacement of the slabs away from one another.

In order to facilitate the transfer of vertical loads across the pour joint 18 between the first pour 14 and the second pour 16, it is contemplated that the dowel plate 22 may be fabricated of a load-bearing material having favorable strength properties. The dowel plate 22 may be fabricated from metal plate such as carbon steel plate. A galvanized coating may be included on the dowel plate 22 in order to provide maximum protection of the metal from exposure to concrete which may otherwise result in corrosion for the embedded portion 58. Other coatings for the metal plate are contemplated and may include powder coatings and epoxy coatings. In addition, the dowel plate 22 may be fabricated from materials other than metal plate such as fiber glass, carbon fiber, Kevlar, or high density and/or high strength materials such as polymeric material or reinforced plastic or any combination of metal and polymeric material.

Referring to FIG. 1, the pocket former 26 has a horizontally-extending interior compartment 42 bounded by a pair of spaced apart, upper and lower former plates 76, 78 generally defining planar, upper and lower inner surfaces 44, 46 of the interior compartment 42. The interior compartment 42 has an open, generally straight side 48 defining a compartment opening 50 and has opposing compartment sides 80 and a compartment end 82. As can be seen in FIGS. 3 and 4, edges of the upper and lower former plates 76, 78 may be chamfered along the straight side 48 such that leakage of wet concrete between the pocket former 26 and the positioner bracket 62 may be prevented. The interior compartment 42 may have an orthogonally-shaped compartment perimeter 52 extending from opposing ends of the straight side 48 such that the interior compartment 42 is generally square or rectangularly shaped.

It is contemplated that the interior compartment 42 may be configured in a variety of alternative shapes with the spacing between the upper and lower former plates 76, 78 being complementary to a thickness of the dowel plate 22 such that a relatively snug, sliding fit is provided therebetween. For example, it is contemplated that the compartment opening 50 is sized to receive the dowel plate 22 therethrough with a minimum gap between edges of the dowel plate 22 and the compartment opening 50. As is shown in FIG. 2, the compartment opening 50 is preferably aligned with the pour joint 18 at a pour face 20 thereof such that a dowel plate opening 24 is created at the pour face 20. In this regard, the dowel plate opening 24 is coincident with the compartment opening 50.

Figure 6:
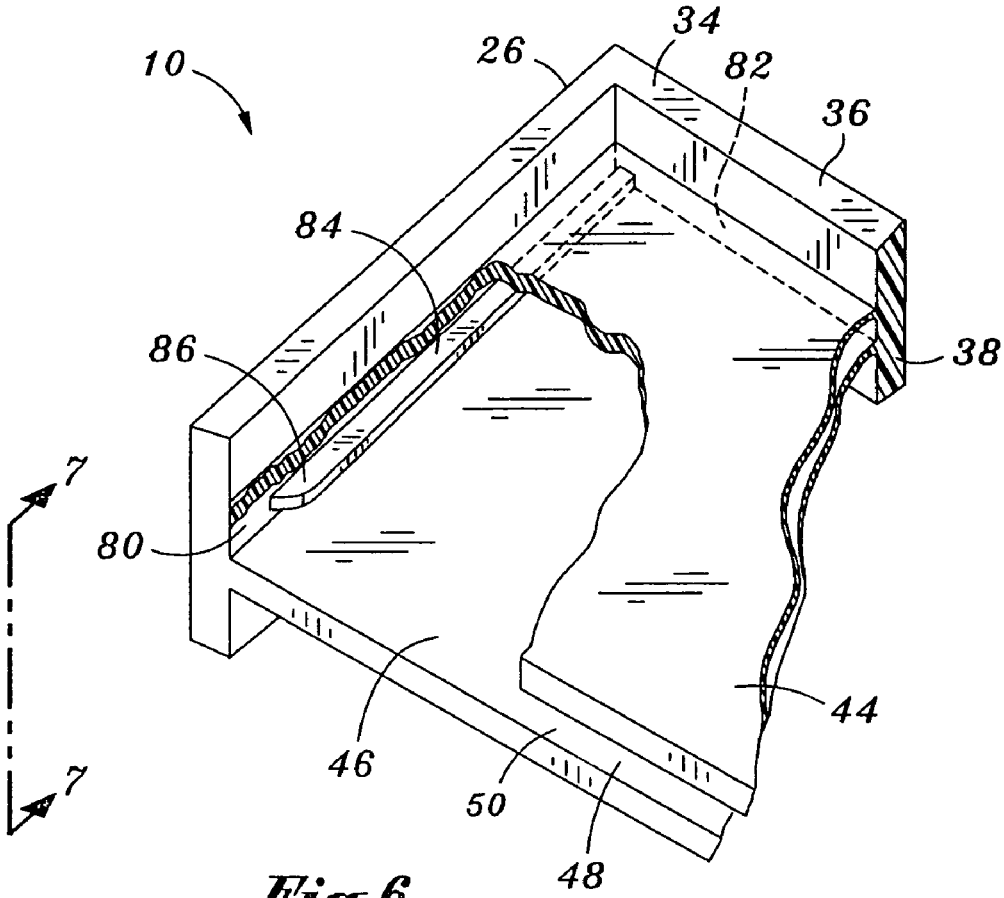
FIG. 6 is an enlarged perspective cutaway view of the pocket former taken along line 6 of FIG. 1 and illustrating a crush rib formed along one of a pair of opposing compartment sides of an interior compartment of the pocket former.
Figure 7:
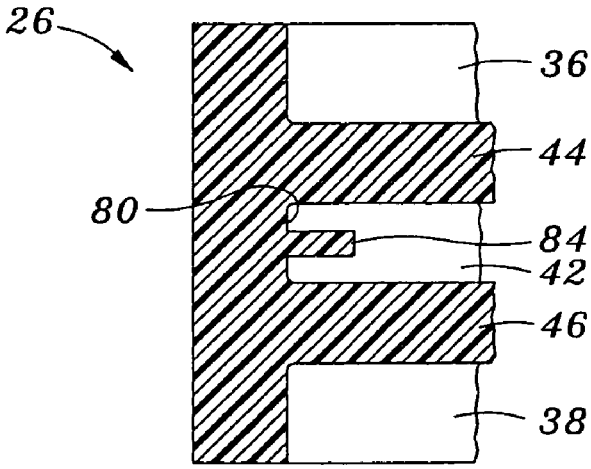
FIG. 7 is a partial end view of the pocket former taken along line 7-7 of FIG. 6 and illustrating the crush rib disposed midway between upper and lower inner surfaces of the interior compartment.

Referring briefly to FIGS. 6-7, the pocket former 26 may optionally include at least one crush rib 84 disposed in the interior compartment 42. As was earlier mentioned, the interior compartment 42 is configured such the open straight side 48 is preferably aligned with the pour joint 18. The pair of opposing compartment sides 80 and compartment end 82, together with the upper and lower inner surfaces 44, 46, collectively enclose the interior compartment 42. At least one or both of the compartment sides 80 may include the crush rib 84 extending longitudinally therealong. The crush ribs 84 may extend along the entire length of the compartment side 80.

The crush ribs 84 may be integrally formed with the pocket former 26 and may generally protrude laterally outwardly therefrom as shown in FIG. 7. Furthermore, the crush ribs 84 may preferably be located generally midway between the upper and lower inner sides 44, 46 of the interior compartment 42 although the crush ribs 84 may be biased toward either one of the upper and lower inner surfaces 44, 46. Although the crush ribs 84 may be provided in a variety of shapes, sizes, and configuration, the generally thin, elongate configuration as shown in the Figures is preferred. In this regard, it is contemplated that each one of the crush ribs 84 may be arranged as a series of individual tabs that are spaced apart from one another. Such intermittent arrangement of the crush ribs 84 may further promote deflection or crushing thereof under load.

Regardless of their configuration, the crush ribs 84 are preferably configured to deflect or crush when the dowel plate 22 moves laterally within the interior compartment 42 causing the dowel plate 22 to bear against the crush ribs 84. Such deflection or crushing of the crush rib 84 may be caused by relative lateral (i.e., horizontal) movement of the first and second pours 14, 16. Each one of the crush ribs 84 may have arcuately contoured proximal ends 86 which terminate inwardly from the open straight side 48 of the interior compartment 42 of the pocket former 26. The arcuate proximal ends 86 may facilitate slidable insertion of the dowel plate 22 into the interior compartment 42. As was earlier mentioned, lateral movement of the dowel plate 22 within the interior compartment 42 is facilitated by the deflection or collapse of either or both of the crush ribs 84.

Importantly, the pocket former 26 is configured to create a void in the first pour 14 such that the dowel plate 22 may be simply slid into the pocket former 26 until a perimeter of the dowel plate 22 is substantially in abutment with the compartment end 82. If the interior compartment 42 includes crush ribs 84, the dowel plate 22 is preferably sized to fit between the crush ribs 84 disposed on each of the opposing compartment sides 80. The dowel plate 22 does not penetrate through the pocket former 26 but preferably is configured to snugly fit therewithin. The pocket former 26 may be configured with internal removable spacers (not shown) that separate the upper and lower inner surfaces 44, 46 during pouring and curing of the first pour 14 such that the upper and lower former plates 76, 78 of the pocket former 26 resist flexure. In this manner, a spacing between the upper and lower former plates 76, 78 is maintained such that the interior compartment 42 will not collapse under the pressure of wet concrete.

As can be seen in FIG. 2, the embedded portion 58 of the dowel plate 22 is rigidly encapsulated within the second pour 16 and the slidable portion 60 of the dowel plate 22 is slidably disposed within the pocket former 26. The dowel plate 22 thus permits horizontal movement of the first pour 14 relative to the second pour 16 while restricting vertical movement of the first pour 14 relative to the second pour 16. Advantageously, the relative horizontal movement includes movement in a direction perpendicular, movement in a direction parallel to the pour joint 18 as well as horizontal movement in all ranges between the parallel and perpendicular directions.

Perpendicular movement relative to the pour joint 18 may occur due to uncontrolled shrinkage or contraction of the concrete mixture as water or moisture is lost during curing. However, due to the orthogonal shape of the dowel plate 22 and the complementary configuration of the interior compartment 42 of the pocket former 26, the disc dowel system 10 allows substantially unrestrained laterally opposing horizontal movement of the first and second pours 14, 16. By allowing the first and second pours 14, 16 to move in a horizontal direction away from one another along the pour joint 18, residual stress accumulations may be reduced which may prevent random cracking of the concrete elsewhere.

Referring still to FIG. 2, it can be seen that the disc dowel system 10 (i.e., the pocket former 26 and the dowel plate 22) may be placed at substantially equal intervals along the pour joint 18. The dowel plate 22 may be sized to have a predetermined thickness and longitudinal geometry based upon a predicted vertical loading differential between the first and second pours 14, 16. Such vertical loading may be comprised of shear, bearing and flexural loads or any combination thereof. As was earlier mentioned, such vertical loading may be caused by settling or swelling of the substrate 12 underlying the first and/or second pours 14, 16.

The vertical loading may also be caused by vehicular or pedestrian traffic passing over the first and second pours 14, 16. In order to transfer such vertical loads across the pour joint 18, an exemplary dowel plate 22 may be sized with a plate thickness of about one-quarter inch and a maximum width at the pour joint 18 of about six inches although the dowel plate 22 may be provided in any thickness. For configurations wherein the dowel plate 22 has a square or rectangular shape, the dowel plate 22 may have a width of about six inches. Typical spacings between disc dowel systems 10 may be about sixteen inches from approximate centers of the installed dowel plates 22 along the pour joint 18 although it is contemplated that the dowel placement system may be installed at any spacing.

Referring briefly now to FIG. 1, the pocket former 26 may include a perimeter flange 34 extending about the interior compartment 42 or pocket former 26 perimeter and being attached to the upper and lower former plates 76, 78. The perimeter flange 34 may be integrally formed with the former plates 76, 78 of the pocket former 26 and may have a generally vertically-oriented cross section with dovetailed or flared upper and lower flange portions 36, 38. The dovetail or flared configuration of the upper and lower flange portions 36, 38 facilitates the locking of the pocket former 26 within the first pour 14 preventing horizontal movement after the concrete cures.

Referring still to FIG. 1, the pocket former 26 includes an upper outer surface 28 and a lower outer surface 30. In order to increase the rigidity or stiffness of the former plates 76, 78 such that the interior compartment 42 may resist flexion under the pressure of wet concrete in the first pour 14, each one of the upper and lower outer surfaces 28, 30 may have a pair of spaced apart, former alignment ribs 40 extending thereacross. The former alignment ribs 40 may be oriented to extend in a direction generally perpendicular to the pour joint 18 from the straight side 48 to the perimeter flange 34. As can be seen in FIG. 1, the former alignment ribs 40 may be integrally formed with the former plates 76, 78. Each one of the former alignment ribs 40 may have a flared cross section similar in shape to the flared cross section of the upper and lower flange portions 36, 38 of the perimeter flange 34. The flared configuration of the former alignment ribs 40 may aid in locking the pocket former 26 against vertical movement after the concrete cures.

Referring now to FIGS. 3-5, the disc dowel system 10 may be configured such that the pocket former 26 may be installed at the pour joint 18 by using the positioner bracket 62 that is mountable to a removable concrete form 56. In certain methods of concrete pavement construction, the removable concrete form 56 is typically comprised of a wooden stud or a sheet metal form. As will be described in greater detail below, such concrete forms 56 are typically staked to the substrate 12 along a desired location of the pour joint 18. The pocket former 26 is positioned adjacent the concrete form 56 such that the interior compartment 42 extends substantially horizontally outwardly away from the concrete form 56.

Wet concrete may then be poured on a side of the concrete form 56 to create the first pour 14 which encapsulates the pocket former 26. The concrete form 56 is then removed, exposing the pour face 20 of the pour joint 18 along the first pour 14 with the dowel plate opening 24 being formed in the pour face 20. After the slidable portion 60 of the dowel plate 22 is inserted through the dowel plate opening 24 and into the pocket former 26, the embedded portion 58 remains exposed on an opposite side of the pour joint 18. Wet concrete may then be poured on the opposite side of the pour joint 18 to create the second pour 16 which rigidly encapsulates the embedded portion 58 of the dowel plate 22 therewithin.

In the disc dowel system 10, the positioner bracket 62 may be mounted on the concrete form 56 to aid in positioning the pocket former 26. In this regard, the positioner bracket 62 is configured to hold the pocket former 26 in a substantially horizontal orientation during pouring and curing of the first pour 14. Referring to FIG. 3, the positioner bracket 62 may include a vertically-disposed base flange 64 and a horizontally-disposed plate portion 68 that extends from the base flange 64. The base flange 64 may be formed as a rectangularly-shaped section of plate configured to be rigidly attachable to the concrete form 56. As can be seen, the base flange 64 may be sized such that peripheral edges thereof do not extend beyond top and bottom edges of the concrete form 56.

The base flange 64 may be disposed in abutting contact with the concrete form 56 and may be affixed thereto by a variety of means such as with fasteners. Toward this end, the base flange 64 may include a pair of apertures 66 extending through the base flange 64 at opposing ends, as is shown in FIG. 3. Each one of the apertures 66 may be sized to permit the passage of a fastener through the base flange 64 for facilitating the rigid attachment of the positioner bracket 62 to the concrete form 56. Such fasteners may include wood screws or nails that are driven into the concrete form 56.

As can be seen in FIG. 3, the plate portion 68 of the positioner bracket 62 may be sized and configured to be complementary to the interior compartment 42 such that the positioner bracket 62 may slidably receive the pocket former 26 with a relatively snug fit. The pocket former 26 is extended over the plate portion 68 to a depth whereat the straight side 48 is in generally abutting contact with the base flange 64. In such a position, a perimeter of the plate portion 68 is disposed adjacent to the compartment perimeter 52 at the compartment end 82. In this manner, the pocket former 26 is held in a generally horizontal orientation during pouring of the first pour 14 and prior to removal of the concrete form 56 and positioner bracket 62 after which the slidable portion 60 of the dowel plate 22 may be inserted into the interior compartment 42 with the subsequent pouring of the second pour 16 to encapsulate the embedded portion 58 therewithin.

Referring still to FIG. 3, the plate portion 68 of the positioner bracket 62 includes upper and lower exterior surfaces 70, 72. A pair of spaced apart positioner alignment ribs 74 may be affixed to or formed on respective ones of the upper and lower exterior surfaces 70, 72. The positioner alignment ribs 74 may extend generally perpendicularly from the base flange 64 to the plate portion 68 perimeter. The interior compartment 42 of the pocket former 26 includes upper and lower inner surfaces 44, 46 which may each have a pair of spaced apart alignment grooves 54 formed therein. The alignment grooves 54 may be sized and configured to be complementary to the positioner alignment ribs 74 such that the positioner alignment ribs 74 line up with the alignment grooves 54. The cooperation of the alignment grooves 54 with the positioner alignment ribs 74 facilitates the rigid securement of the pocket former 26 to the positioner bracket 62 during pouring of the first pour 14.

Regarding the material from which the pocket former 26 and positioner bracket 62 may be fabricated, it is contemplated that polymeric or plastic material may preferably be used. The pocket former 26 and positioner bracket 62 may each be separately injection molded of high-density plastic material such as polyethylene plastic in order to impart sufficient strength and stiffness to the pocket former 26 and the positioner bracket 62. Alternatively, it is contemplated that the pocket former 26 and positioner bracket 62 may each be fabricated from materials such as fiberglass and carbon fiber. The former alignment ribs 40, alignment grooves 54 and perimeter flange 34, if included, may also be integrally formed with the pocket former 26 as a unitary structure by way of injection molding. Likewise, the base flange 64, plate portion 68, apertures 66 and positioner alignment ribs 74 may be integrally formed as a unitary structure of the positioner bracket 62 in an injection molding process The method of installing the dowel plate 22 within the pour joint 18 using the disc dowel system 10 will now be described with reference to FIGS. 1 through 5. As was earlier mentioned, the dowel plate 22 is installed within the pour joint 18 between adjacent first and second concrete pours 14, 16 as is shown in FIG. 5. As is illustrated in FIG. 2, multiple ones of the disc dowel system 10 of the present invention may be installed along the pour joint 18 in equidistantly spaced relation to each other. The dowel plate 22 may be configured complementary to the pocket former 26. Initially, the disc dowel system 10 is utilized by positioning the concrete form 56 along a desired location of the pour joint 18, as is shown in FIG. 4. The concrete form 56 is typically supported by stakes that are secured to the substrate 12 at spaced intervals along the desired location of the pour joint 18.

If the disc dowel system 10 includes a positioner bracket 62 for facilitating the installation of the pocket former 26 within the first pour 14, the positioner bracket 62 is secured to the concrete form 56 by initially placing the base flange 64 in abutting contact with a side of the concrete form 56. The base flange 64 may be approximately vertically centered on the side of the concrete form 56 such that the plate portion 68 extends substantially horizontally outwardly from the concrete form 56, as can be seen in FIG. 3. Fasteners such as screws or nails may be driven through the apertures 66 of the base flange 64 and into the concrete form 56 in order to secure the positioner bracket 62 thereto.

After the positioner bracket 62 is secured to the concrete form 56, the pocket former 26 is slidably extended over the positioner bracket 62 until the open straight side 48 of the pocket former 26 is in substantially abutting contact with the base flange 64, as shown in FIG. 4. As was earlier mentioned, edges of the upper and lower former plates 76, 78 may be chamfered such that the upper and lower former plates 76, 78 may be placed in substantially abutting contact with the base flange 64 along the compartment opening 50.

The chamfered edges of the upper and lower former plates 76, 78 may prevent leakage of wet concrete between the pocket former 26 and the positioner bracket 62 which may otherwise hinder the removal of the positioner bracket 62 from the pocket former 26 after the concrete has cured or hardened. If positioner alignment ribs 74 and complementary alignment grooves 54 are included with respective ones of the positioner bracket 62 and the pocket former 26 as is illustrated in FIG. 3, the positioner alignment ribs 74 are aligned with the alignment grooves 54 as the pocket former 26 is slidably extended over the positioner bracket 62.

After the pocket former 26 is slidably extended over the positioner bracket 62, the first pour 14 of concrete is made about the pocket former 26 such that the pocket former 26 is rigidly encapsulated therewithin, as shown in FIG. 4. The bond between the concrete of the first pour 14 and the pocket former 26 may be enhanced if the former alignment ribs 40 and the perimeter flange 34 are included with the pocket former 26, as is illustrated in FIG. 1.

Subsequent to curing and hardening of the first pour 14 of concrete, the concrete form 56 is removed exposing the pour face 20 of the pour joint 18. The removal of the concrete form 56 also causes the positioner bracket 62 to be removed from within the pocket former 26. The positioner bracket 62 remains in rigid attachment to the concrete form 56. Separating the positioner bracket 62 from the concrete form 56 may allow multiple uses of the positioner bracket 62. Removal of the concrete form 56 exposes the dowel plate opening 24 in the pour face 20 of the pour joint 18, as may be seen in FIG. 2.

After the concrete form 56 and the positioner bracket 62 are removed and the concrete has cured and hardened, the slidable portion 60 of the dowel plate 22 may be inserted through the open straight side 48 and into the interior compartment 42 of the pocket former 26 leaving the embedded portion 58 exposed on an opposite side of the pour joint 18. The dowel plate 22 may be sized and configured to be complementary to the interior compartment 42 such that a relatively snug, sliding fit is provided between the dowel plate 22 and the pocket former 26. In this manner, vertical play or looseness between the dowel plate 22 and the interior compartment 42 may be minimized such that vertical loads may be effectively transferred across the pour joint 18 between the first and second pours 14, 16 in order to maintain a common plane therebetween. If crush ribs 84 are included in the pocket former 26, the dowel plate 22 is preferably sized to fit between the crush ribs 84 extending along the compartment sides 80.

After the dowel plate 22 is inserted into the pocket former 26, the second pour 16 of concrete is made such that the embedded portion 58 of the dowel plate 22 is rigidly encapsulated therewithin with the slidable portion 60 being slidably disposed within the pocket former 26. Due to the snug fit between the dowel plate 22 and the pocket former 26, the concrete of the second pour 16 is prevented from seeping into the interior compartment 42 of the pocket former 26 which may otherwise cause the dowel plate 22 to bond to the pocket former 26.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. A disc dowel system interposed between adjacent first and second concrete pours defining a pour joint therebetween, the disc dowel system comprising:

a dowel plate having an orthogonal shape and defining an embedded portion and a slidable portion; and an orthogonally shaped pocket former disposed within the first pour and having a laterally extending interior compartment with an open generally straight side, a pair of opposing compartment sides and a compartment end, the straight side being aligned with the pour joint, at least one of the compartment sides including a pair of crush ribs extending longitudinally therealong, the pocket former including a perimeter flange extending along a perimeter edge thereof;

wherein the embedded portion is rigidly encapsulated within the second pour and the slidable portion is slidably disposed within the pocket former, the crush ribs being configured to deflect such that the dowel plate permits relative horizontal movement of the first and second pours while resisting relative vertical movement thereof;

the interior compartment being configured in one of a rectangular shape and a square shape;

the slidable portion being shaped complementary to the interior compartment such that relative sideways movement of the first and second pours is minimized during relative opposing movement thereof.

2. The disc dowel system of claim 1 wherein the crush ribs has an arcuately contoured proximal end terminating adjacent the straight side of the interior compartment.

3. The disc dowel system of claim 1 wherein the interior compartment is sized and configured to be complementary to the dowel plate.

4. The disc dowel system of claim 1 wherein the perimeter flange has a generally vertically-oriented cross section with upper and lower flange portions configured for resisting horizontal movement of the pocket former relative to the first pour.

5. A disc dowel system interposed between adjacent first and second concrete pours defining a pour joint therebetween, the disc dowel system comprising:

a dowel plate having an orthogonal shape and defining an embedded portion and a slidable portion; and a pocket former disposed within the first pour and having a laterally extending interior compartment with an open generally straight side, a pair of opposing compartment sides and a compartment end, the straight side being aligned with the pour joint, at least one of the compartment sides including a pair of crush ribs extending longitudinally therealong;

wherein the pocket former includes upper and lower outer surfaces each having a spaced pair of former alignment ribs extending thereacross in a direction generally perpendicular to the pour joint.

6. The disc dowel system of claim 5 wherein each one of the former alignment ribs has a flared cross section configured for resisting vertical movement of the pocket former within the first pour.

7. A disc dowel system for installing an orthogonally shaped dowel plate within a pour joint between adjacent first and second concrete pours, the pour joint being formed by a concrete form, the dowel plate having a generally orthogonal shape with an embedded portion and a slidable portion, the disc dowel system comprising:

a positioner bracket having a vertically disposed base flange and a horizontal plate portion, the base flange being attachable to the concrete form; and a pocket former having a laterally extending interior compartment provided in one of a rectangular shape and a square shape and configured to be complementary to the dowel plate, the interior compartment having an open straight side, a pair of opposing compartment sides and a compartment end, the straight side being aligned with the pour joint, each one of the compartment sides including a pair of crush ribs extending longitudinally therealong, the pocket former having a perimeter flange extending along a perimeter edge of the pocket former and being formed of upper and lower flanges contiguous with one another, the slidable portion being shaped complementary to the interior compartment such that lateral sideways displacement of the first and second pours is prevented regardless of the amount of laterally opposing displacement of the first and second pours;

wherein the plate portion is sized and configured to be complementary to the interior compartment such that the positioner bracket may slidably receive the pocket former with the straight side generally abutting the base flange during pouring of the first pour prior to removal of the concrete form and positioner bracket for subsequent insertion of the slidable portion into the interior compartment and pouring of the second pour to encapsulate the embedded portion therewithin.

8. The disc dowel system of claim 7 wherein at least one of the crush ribs has an arcuately contoured proximal end terminating adjacent the straight side of the interior compartment.

9. The disc dowel system of claim 7 wherein:

the plate portion includes upper and lower exterior surfaces each having a pair of spaced apart positioner alignment ribs extending generally perpendicularly relative to the pour joint; and the interior compartment includes upper and lower inner surfaces each having a spaced pair of alignment grooves sized and configured to receive the positioner alignment ribs such that the pocket former is held in alignment with the positioner bracket during pouring of the first pour.

10. The disc dowel system of claim 7 wherein the orthogonally shaped dowel plate is generally configured into one of a square shape and a rectangular shape.

11. The disc dowel system of claim 7 wherein the perimeter flange has a generally vertically-oriented cross section with flared upper and lower flange portions configured for resisting horizontal movement of the pocket former within the first pour.

12. A disc dowel system for installing an orthogonally shaped dowel plate within a pour joint between adjacent first and second concrete pours, the pour joint being formed by a concrete form, the dowel plate having a generally orthogonal shape with an embedded portion and a slidable portion, the disc dowel system comprising:

a positioner bracket having a vertically disposed base flange and a horizontal plate portion, the base flange being attachable to the concrete form; and a pocket former having a laterally extending interior compartment configured to be complementary to the dowel plate, the interior compartment having an open straight side, a pair of opposing compartment sides and a compartment end, the straight side being aligned with the pour joint, each one of the compartment sides including a pair of crush ribs extending longitudinally therealong, the pocket former having a perimeter flange extending along a perimeter of the pocket former wherein:

the plate portion is sized and configured to be complementary to the interior compartment such that the positioner bracket may slidably receive the pocket former with the straight side generally abutting the base flange during pouring of the first pour prior to removal of the concrete form and positioner bracket for subsequent insertion of the slidable portion into the interior compartment and pouring of the second pour to encapsulate the embedded portion therewithin;

the pocket former has upper and lower outer surfaces each having a pair of spaced apart former alignment ribs extending generally perpendicularly from the pour joint with each one of the former alignment ribs having a flared cross section configured for restricting vertical movement of the pocket former within the first pour.

13. A method for installing a generally orthogonally shaped dowel plate within a pour joint between adjacent first and second concrete pours using a pocket former having an interior compartment with an open, straight side, a pair of opposing compartment sides and a compartment end, the straight side being aligned with the pour joint, each one of the compartment sides including a pair of crush ribs extending longitudinally therealong, the interior compartment being provided in at least one of a rectangular shape and a square shape and being configured complementary to the dowel plate, the dowel plate defining an embedded portion and a slidable portion, the method comprising the steps of:

positioning a concrete form along a desired location of the pour joint;

positioning the pocket former adjacent to the concrete form such that the interior compartment extends substantially horizontally outwardly therefrom with the straight side being disposed in abutment with the concrete form, the pocket former including a perimeter flange extending along a perimeter edge thereof and being formed of upper and lower flanges contiguous with one another;

pouring the first pour such that the pocket former is rigidly encapsulated therewithin;

removing the concrete form after the first pour has cured;

inserting the slidable portion into the interior compartment; and pouring the second pour such that the embedded portion is rigidly encapsulated within the second pour and the slidable portion is slidably disposed within the pocket former.

14. The method of claim 13 using a positioner bracket having a vertically disposed base flange and a plate portion extending horizontally therefrom, the method comprising the additional steps of:

securing the base flange to the concrete form such that such that the positioner bracket is rigidly attached thereto with the plate portion extending substantially horizontally outwardly therefrom;

sliding the pocket former over the positioner bracket such that the straight side is in abutment with the base flange; and removing the positioner bracket from the pocket former after the first pour has cured.

15. A pocket former for a disc dowel system adapted to minimize relative vertical displacement of adjacently disposed concrete slabs, the pocket former comprising:

an interior compartment configured in one of a rectangular shape and a square shape and having upper and lower outer surfaces with at least one former alignment rib disposed on at least one of the upper and lower outer surfaces, the interior compartment having an open, straight side, a pair of opposing compartment sides and a compartment end, each one of the compartment sides including a pair of crush ribs extending longitudinally therealong, the pocket former including a perimeter flange extending along a perimeter edge thereof and being formed of upper and lower flanges contiguous with one another; wherein:

the pocket former is adapted to be encapsulated within one of the adjacently disposed concrete slabs.

16. The pocket former of claim 15 wherein:

the pocket former is sized and configured to receive a dowel plate;

the dowel plate being sized and configured to be complementary to the interior compartment and having a slidable portion and an embedded portion;

the slidable portion being configured to be laterally slidable within the interior compartment;

the embedded portion being configured to be encapsulated within the other one of the adjacently disposed concrete slabs.

17. A pocket former for a disc dowel system adapted to be encapsulated within one of adjacently disposed concrete slabs for minimizing relative vertical displacement of the concrete slabs, the pocket former comprising:

an orthogonally shaped interior compartment having upper and lower outer surfaces with at least one former alignment rib disposed on at least one of the upper and lower outer surfaces, the interior compartment having an open, straight side, a pair of opposing compartment sides and a compartment end, each one of the compartment sides including a pair of crush ribs extending longitudinally therealong;

a perimeter flange extending about a compartment perimeter and having a generally vertically-oriented cross section with flared upper and lower flange portions.

18. The pocket former of claim 15 wherein the former alignment rib is oriented generally perpendicularly relative to the straight side.

19. An orthogonally shaped dowel plate for a disc dowel system adapted to minimize relative vertical displacement of adjacently disposed concrete slabs, the dowel plate comprising:

a slidable portion and an embedded portion; wherein:

the slidable portion provided in at least one of a rectangular shape and a square shape and being configured to be laterally slidable within a pocket former having horizontally oriented upper and lower outer surfaces and defining an interior compartment being shaped complementary to the slidable portion such that lateral sideways displacement of the first and second pours is prevented regardless of the amount of laterally opposing displacement of the first and second pours;

at least one of the upper and lower outer surfaces having at least one former alignment rib disposed thereon;

the pocket former including a perimeter flange extending alone a perimeter edge thereof and being formed of upper and lower flanges contiguous with one another;

the embedded portion being configured to be encapsulated within one of the adjacently disposed concrete slabs.

20. The dowel plate of claim 19 wherein:

the pocket former has an interior compartment configured to be complementary to the generally orthogonally shaped dowel plate;

the interior compartment having an open, generally straight side and a compartment perimeter;

the interior compartment being configured to slidably receive the slidable portion.

21. A positioner bracket for installing an orthogonally shaped pocket former of a disc dowel system within a pour joint located between adjacent first and second concrete pours, the pocket former having an interior compartment with an open, straight side and a pair of opposing compartment sides, each one of the compartment sides including a pair of crush ribs extending longitudinally therealong, the pour joint being formable by a concrete form, the pocket former including a perimeter flange extending along a perimeter edge thereof and being formed of upper and lower flanges contiguous with one another, the positioner bracket comprising:

a base flange;

an orthogonally shaped plate portion extending laterally outwardly from the base flange and including upper and lower exterior surfaces and at least one positioner alignment rib formed on at least one of the exterior surfaces; wherein:

the plate portion is sized and configured to be complementary to the pocket former;

the base flange being configured to be attachable to the concrete form.

22. A positioner bracket for installing an orthogonally shaped pocket former of a disc dowel system within a pour joint located between adjacent first and second concrete pours, the pocket former having an interior compartment with an open, straight side and a pair of opposing compartment sides, each one of the compartment sides including a pair of crush ribs extending longitudinally therealong, the pour joint being formable by a concrete form, the positioner bracket comprising:

a base flange;

an orthogonally shaped plate portion extending laterally outwardly from the base flange and including upper and lower exterior surfaces and at least one positioner alignment rib formed on at least one of the exterior surfaces; wherein:

the plate portion is sized and configured to be complementary to the pocket former;

the base flange being configured to be attachable to the concrete form;

the pocket former includes an interior compartment having at least one groove formed therein;

the groove being sized and configured to receive the positioner alignment rib such that the pocket former is held in alignment with the positioner bracket.

* * * * *